United States Patent [19]

Lampert

[11] 4,294,084

[45] Oct. 13, 1981

[54] ARTICLE OF JEWELRY WITH RECIPROCALLY MOVABLE GEM

[76] Inventor: Lester M. Lampert, 2304 Greenview Rd., Northbrook, Ill. 60048

[21] Appl. No.: 715,987

[22] Filed: Aug. 19, 1976

[51] Int. Cl.[3] ..... A44C 9/00; A44C 17/02

[52] U.S. Cl. ..... 63/15; 63/31

[58] Field of Search ..... 63/26, 27, 28, 31, 20

[56] References Cited

U.S. PATENT DOCUMENTS

| | | | |
|---|---|---|---|
| 1,389,031 | 8/1921 | Cumming | 63/26 |
| 2,148,624 | 2/1939 | Janowitz | 63/26 UX |
| 2,258,413 | 10/1941 | Koven | 63/31 |
| 3,177,682 | 4/1965 | Razza | 63/31 X |
| 3,273,766 | 9/1966 | Consentino | 63/31 X |

FOREIGN PATENT DOCUMENTS

| | | | |
|---|---|---|---|
| 600734 | 7/1934 | Fed. Rep. of Germany | 63/31 |
| 785074 | 5/1935 | France | 63/31 |
| 822777 | 9/1937 | France | 63/28 |
| 165289 | 6/1921 | United Kingdom | 63/20 |

*Primary Examiner*—F. Barry Shay

*Attorney, Agent, or Firm*—Silverman, Cass & Singer, Ltd.

[57] ABSTRACT

An article of jewelry, such as a finger ring, having a mounting for a precious or semi-precious gem, sometimes referred to as a "jewel", which enables the jewel to be freely, reciprocally movable. Such movement is permitted concurrently with movement of the wearer's finger so as to achieve eye-catching esthetic effects and unexpected enhancement of reflection of light from the jewel so as to increase its visual brilliance and beauty.

9 Claims, 4 Drawing Figures

FIG. 1
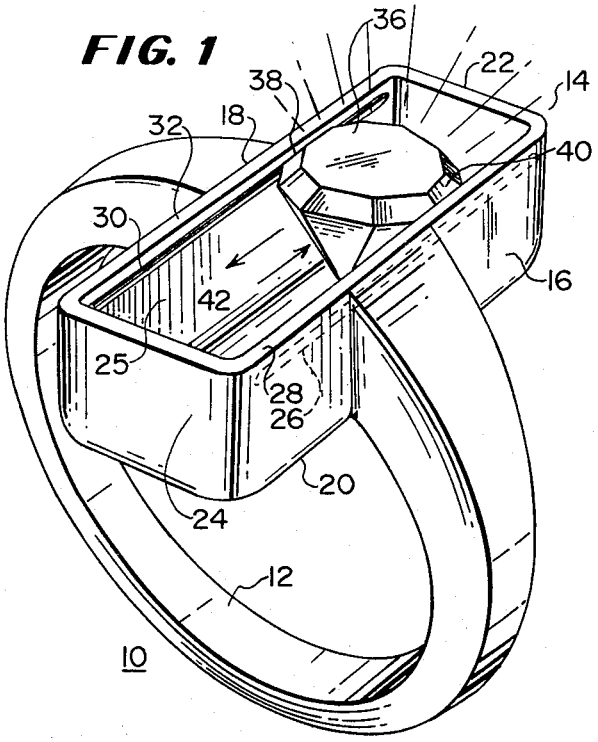
FIG. 1A
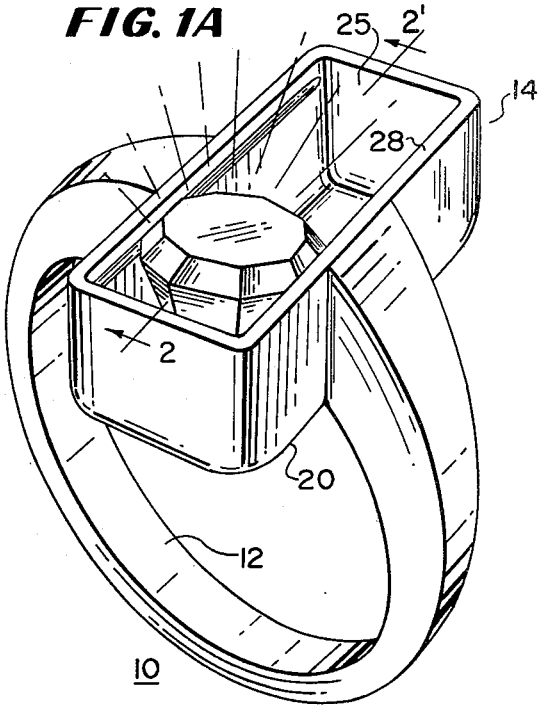
FIG. 2
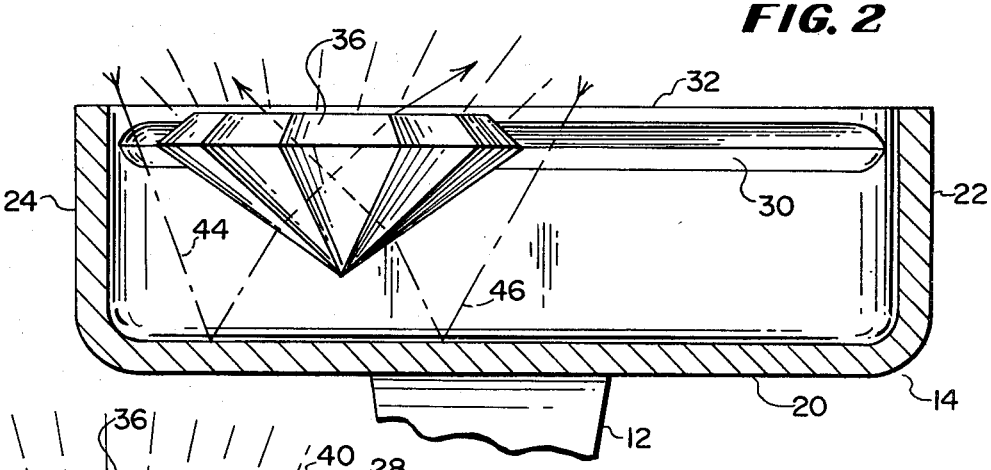
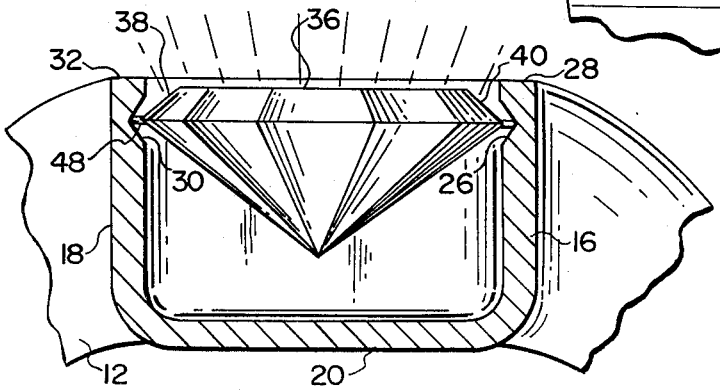
FIG. 3

ARTICLE OF JEWELRY WITH RECIPROCALLY MOVABLE GEM

BACKGROUND OF THE INVENTION

This invention is related to articles of jewelry and more particularly, to an improved mounting for precious or semi-precious gems in a freely reciprocal condition so as to achieve unusual and unexpected visual effects.

Gem stones, sometimes referred to as "jewels", are cut and faceted in order to enhance their brilliance. The faceting, if performed properly, produces a maximum amount of light reflection within and from the jewel. It is known that the faceting of a jewel is a very skilled and exacting art. Oftentimes, because of the natural characteristics of a stone, or because of inability, inexperience or accident on the part of the gem cutter, it is not possible to perfectly facet a gem stone. As a result, a jewel of less than full brilliance is produced. Further, precious or semi-precious stones, whether faceted or unfaceted, will vary in brilliance in accordance with their quality. The better quality jewels, for instance, are more brilliant in appearance and, of course, more expensive.

In the case of diamonds, stones of lesser brilliance and faceted quality still are in great demand. Mountings for gems have been developed which attempt to increase the amount of light permitted to impinge upon and pass through a gem stone in order to increase the apparent brilliance of such stones. Such mounting structures are not only employed with the less perfect stones noted above, but are also utilized with very fine stones to increase their apparent brilliance. Generally, however, such mountings have maximized the amount of light impinging directly on the entire jewel. Prior art attempts have not utilized movement of the gem in its mounting on the article of jewelry in order to increase the amount of light passed to and through the jewel, thereby increasing its brilliance. Further, the prior art has not sought to provide a jewel mounting which will collect the unavailable light and pass the same through the stone for enhancing its brilliance and thereby enable jewels of lesser quality and value to be used but with increased esthetic beauty comparable to that achieved with more expensive jewels.

SUMMARY OF THE INVENTION

An article of jewelry, such as a ring or a pendant, is provided with a novel mounting for the gem or jewel associated therewith. Said mounting has opposed side walls of elongated configuration designed to provide a desired run for reciprocal free movement of the jewel or gem in the mounting. Such a run is achieved by means of a pair of oppositely facing tracks spaced above the floor of the mounting to provide clearance for the jewel so that it can move freely, as desired. The gem is keyed or journalled in said tracks for reciprocal movement therein freely when the mounting is moved.

The length of the mounting is substantially greater than the width of the jewel across its face so that the mounting provides an open portion thereinto when the jewel is in any position therein, either at the extremities or in a medial portion of the mounting. Such opening or access into the interior of the mounting enables light rays to enter the mounting and be judiciously reflected from the interior wall surfaces of the mounting into the jewel for refraction in and transmittal out of the jewel. The interior wall surfaces of the mounting are polished so that light reflection therefrom is enhanced. The combined visual effects of free gem movement in the mounting and the increased visual brilliance of the jewel resulting from the enhanced light reflection through and from the jewel achieve unexpectedly improved jewel beauty even where less expensive jewels are used.

In one embodiment of the invention, the gem or jewel is movably mounted by means of a pair of its facet edges slidably engaged in the tracks. In another embodiment, the jewel is provided with a pair of protruding trunnions or bearings which are slidably engaged in said tracks.

BRIEF DESCRIPTION OF THE DRAWINGS

FIG. 1 is a perspective view of an article of jewelry in the form of a finger ring embodying the invention and showing the mounting with a jewel or gem reciprocally positioned therein.

FIG. 1A is a perspective view of the article of FIG. 1 and showing the jewel moved to another position in said mounting.

FIG. 2 is a fragmentary partly sectional view taken along the line 2—2 of FIG. 1A and in the general direction indicated, but showing the jewel in full elevation.

FIG. 3 is a fragmentary sectional view taken transversely through the mounting embodying the invention but showing a modified manner of securing a jewel for sliding movement in the opposed tracks of the mounting.

DETAILED DESCRIPTION OF THE PREFERRED EMBODIMENTS

In one embodiment of the invention shown in FIGS. 1, 1A and 2, an article of jewelry is shown in the preferred form of a ring 10. Ring 10 includes a finger encircling band 12 and a gem or jewel mounting structure represented generally at 14, supported by the band 12. Mounting structure 14 includes a first side wall 16 and a second side wall 18 which are vertically oriented in spaced apart parallel planes, a bottom wall or floor 20, and opposite end walls 22 and 24, respectively. Side walls 16 and 18 are equal in length and provide the longer walls of the rectangular-shaped mounting 14. The walls 16–24 are conjoined together forming a trough-like mounting of generally elongated, rectangular configuration opening upwardly as at 25, oppositely to its floor 20. The inner surfaces of the walls of mounting 14 preferably are polished. In this art, it is common to make the rings of gold, silver, platinum or the like which can be highly polished and which will retain such polish or be capable of renewing such polished surfaces.

A track or groove 26 is formed in the inner surface of side wall 16 which extends substantially the entire length thereof spaced slightly below top edge 28 of side wall 16. A second track or groove 30 is formed in the inner surface of side wall 18 which extends substantially the entire length thereof spaced slightly below top edge 32 of side wall 18. The tracks 26 and 30 are aligned one opposite the other and extend in a direction parallel to the horizontal axis of the band 12 and normal to the vertical plane of said band. Thus, when the ring 10 is worn, the open end 25 of the mounting will extend along the length of the finger on which worn.

A faceted jewel 36 is illustrated as a brilliant, cut diamond in the Figures. The jewel 36 is faceted conventionally to provide a tapered projection or bearing surface 38 and a like, but oppositely facing projection or bearing surface 40 in jewel 36. The projections 38 and 40 are best seen in FIG. 3. Although only two projections 38 and 40 have been specifically identified, it will be understood that a cut diamond 36 usually is faceted around the perimeter of its face and these taper outwardly to provide the so-called projections or bearing surfaces utilized. Any oppositely positioned projections may be utilized as herein described.

Diamond 36 has the projections 38 and 40 slidably seated in tracks 30 and 26, thereby allowing movement of jewel 36 concurrently with movement of the wearer's finger along the length of tracks 30 and 26, as shown by the arrows 42 in FIG. 1. In FIG. 1, the jewel 36 is positioned adjacent end wall 22, and in FIG. 1A, jewel 36 is positioned adjacent end wall 24. The repositioning of the jewel 36 by sliding along tracks 26 and 30 may be accomplished by the ring wearer as desired in order to achieve eye-catching esthetic effects and unexpected enhancement of reflection of light from jewel 36 so as to increase its visual brilliance and beauty.

The interior surfaces of mounting structure 14 preferably are highly polished thereby causing light rays, represented by dashed arrows 44 and 46 in FIG. 2, entering the mounting 14 to be reflected from the walls thereof. The connecting walls of the mounting structure 14 function as a collector and reflector of light. By the appropriate positioning of the mounting structure 14 with respect to a light source and the appropriate alignment of jewel 36 in the mounting 14, a maximum amount of collected and reflected light may be passed through jewel 36. This substantial amount of light passing through stone 36 from below and on sides thereof will enhance the apparent brilliance of the jewel and thus, substantially enhance its beauty and quality to an observer. The brilliance enhancement produced will, of course, act to increase the apparent value and beauty of stones having less than the finest quality and faceting as well as increasing the beauty and brilliance of stones of the finest quality and faceting.

Referring now to FIG. 3, an alternate embodiment of the invention is shown. In this embodiment the tapered edges 38 and 40 of stone 36 are not mounted directly into the tracks 26 and 30. Rather, a pintle or pin 48 protrudes from edge 38 and a second pin 50 protrudes from edge 40. The pins or pintles 48 and 50 are slidably seated in tracks 30 and 26, respectively. Thus, specific faceting of the gem is not required in this embodiment.

Although not specifically described, it will be appreciated that the depth of the mounting 14 is selected to permit the jewel to clear the floor thereof so that sliding movement of the jewel in the mounting is not hampered. Also, the greater length of the mounting relative to the dimensions across the face of the jewel permits light rays to enter through open end 25 into the mounting in all positions of the jewel. The type of gem or jewel employed may vary as can the type of polished metal surface employed for the mounting 14. Also, similar advantageous results may be realized where the item of jewelry is a bracelet or broach or pendant which uses the mounting 14.

While the present invention has been described by reference to specific examples, it is to be understood that modifications may be made by those skilled in the art without actually departing from the spirit of the invention as shown and described herein. It is, therefore, intended that the appended claims cover all variations that fall within the scope of and spirit of this invention.

What it is desired to be secured by Letters Patent of the United States is:

1. An article of jewelry including a single jewel or gem having a pair of oppositely facing edges comprising, in combination, a mounting having elongated side walls of a length substantially greater than the largest dimension of said jewel or gem, a pair of end walls, a bottom wall and an open top end, said side walls being positioned opposed one another, and having parallel aligned tracks therein of a length substantially greater than said dimension spaced below said open end, said jewel or gem being mounted for free reciprocal movement along said tracks upon random tilting of said mounting, said open end being dimensioned to permit entry of light rays into the mounting past said jewel or gem for reflection into the jewel from interior wall surfaces of the mounting.

2. The article of jewelry of claim 1 wherein said mounting has a substantially rectangular cross-section and said opposed side walls are parallel one to the other.

3. The article of jewelry of claim 2 wherein said tracks extend substantially the entire length of said opposed side walls for allowing movement of said jewel along substantially the entire length of said mounting.

4. The article of jewelry of claim 1 wherein said opposed side walls have a top edge, said tracks being formed in said side walls contiguous said top edge and parallel thereto, the depth of the mounting being greater than the length of the jewel.

5. The article of claim 1 in which the interior surfaces of said mounting are highly polished.

6. An article as described in claim 2 in which said jewel has oppositely facing tapered edges slidably engaged in said tracks.

7. An article as described in claim 2 in which said jewel has a pair of oppositely facing pins slidably engaged in said tracks.

8. The article of jewelry of claim 1 including a finger encircling band secured to said mounting.

9. An article of jewelry comprising a setting and at least one stone carried in said setting wherein the setting comprises guide means slidably holding said stone, said stone having a top side and a bottom side and being adapted to move in said guide means upon random tilting of said setting while being constrained by said guide means to movement in a linear path with said top side maintained uppermost in said setting.

* * * * *